US010882271B2

(12) United States Patent
Lang et al.

(10) Patent No.: US 10,882,271 B2
(45) Date of Patent: Jan. 5, 2021

(54) CORRUGATED SHEET PROCESSING APPARATUS

(71) Applicant: DS Smith Packaging Ltd, London (GB)

(72) Inventors: Tony Lang, London (GB); Stephen Williamson, London (GB); Glyn Tomlinson, London (GB)

(73) Assignee: DS SMITH PACKAGING LTD

( * ) Notice: Subject to any disclaimer, the term of this patent is extended or adjusted under 35 U.S.C. 154(b) by 223 days.

(21) Appl. No.: 15/761,542

(22) PCT Filed: Jul. 27, 2016

(86) PCT No.: PCT/GB2016/052291
§ 371 (c)(1),
(2) Date: Mar. 20, 2018

(87) PCT Pub. No.: WO2017/051146
PCT Pub. Date: Mar. 30, 2017

(65) Prior Publication Data

US 2018/0345619 A1 Dec. 6, 2018

(30) Foreign Application Priority Data

Sep. 22, 2015 (GB) ..... 1516772.9
Mar. 2, 2016 (GB) ..... 1603626.1

(51) Int. Cl.
*B31F 1/28* (2006.01)
*B65H 35/02* (2006.01)
(Continued)

(52) U.S. Cl.
CPC ..... *B31F 1/2831* (2013.01); *B31F 1/289* (2013.01); *B31F 1/2813* (2013.01);
(Continued)

(58) Field of Classification Search
CPC ..... B31F 1/2813; B31F 1/2831; B31F 1/21; B31F 1/2818; B31F 1/2822; B31F 1/289;
(Continued)

(56) References Cited

U.S. PATENT DOCUMENTS 4,576,663 A * 3/1986 Bory ..... B31F 1/2831 156/361
5,816,994 A 10/1998 Hill et al.
(Continued)

FOREIGN PATENT DOCUMENTS

CN 1149016 5/1997
CN 1469802 1/2004
(Continued)

OTHER PUBLICATIONS

Search Report which issued for GB1603626.1 dated Oct. 10, 2016.
Search Report which issued for CN201680055379.3 dated Oct. 13, 2019.

*Primary Examiner* — Robert F Long
*Assistant Examiner* — Eduardo R Ferrero
(74) *Attorney, Agent, or Firm* — James R. Foley; Clark Hill PLC

(57) ABSTRACT

A corrugated sheet processing apparatus (120) is disclosed, comprising feed and guide rollers for selecting, moving and supporting sheets or webs to a corrugator (136) for forming a corrugated sheet; and a control system for controlling the sheet processing equipment (136) or a cutter (148); the sheet processing apparatus (136) further comprising a visual inspection unit (162) for reading printed information markers on at least one printed sheet or web as the printed sheet or web pass through the corrugated sheet processing apparatus (136) or corrugator; and wherein the control system further has a data look-up table whereby the apparatus (120) can identify what products will be produced downstream of
(Continued)

the visual inspection unit, and the required settings for the sheet processing equipment or corrugator for those products.

19 Claims, 13 Drawing Sheets

(51) Int. Cl.

| | |
|---|---|
| ***B65H 35/08*** | (2006.01) |
| ***B65H 23/18*** | (2006.01) |
| ***B65H 21/00*** | (2006.01) |
| *B31B 50/88* | (2017.01) |
| *B31B 50/00* | (2017.01) |
| *B31B 50/14* | (2017.01) |
| *B31B 50/16* | (2017.01) |
| *B31B 50/20* | (2017.01) |
| *B31B 120/70* | (2017.01) |
| *B31B 120/10* | (2017.01) |

(52) U.S. Cl.
CPC ..... *B31F 1/2818* (2013.01); *B31F 1/2822* (2013.01); *B65H 21/00* (2013.01); *B65H 23/18* (2013.01); *B65H 35/02* (2013.01); *B65H 35/08* (2013.01); *B31B 50/006* (2017.08); *B31B 50/14* (2017.08); *B31B 50/16* (2017.08); *B31B 50/20* (2017.08); *B31B 50/88* (2017.08); *B31B 2120/10* (2017.08); *B31B 2120/70* (2017.08); *B65H 2301/4148* (2013.01); *B65H 2301/51512* (2013.01); *B65H 2301/515323* (2013.01); *B65H 2553/42* (2013.01); *B65H 2701/1762* (2013.01)

(58) Field of Classification Search
CPC ..... B32B 41/00; B65H 21/00; B65H 23/18; B65H 35/02; B65H 35/08; B65H 2301/4148; B65H 2301/51512; B65H 2301/515323; B65H 2553/42; B65H 2701/1762; B31B 50/006; B31B 50/14; B31B 50/16; B31B 50/20; B31B 50/88
USPC ..... 493/22
See application file for complete search history.

(56) References Cited

U.S. PATENT DOCUMENTS

| | | | | |
|---|---|---|---|---|
| 5,970,682 | A * | 10/1999 | Focke | B65B 19/28 493/12 |
| 5,980,440 | A * | 11/1999 | Mitman | B31B 50/00 493/128 |
| 2005/0085362 | A1* | 4/2005 | Hutchinson | B31B 50/00 493/11 |
| 2006/0027303 | A1* | 2/2006 | Hunter | B31B 50/00 156/64 |
| 2008/0308215 | A1 | 12/2008 | Kraus et al. | |
| 2010/0163154 | A1* | 7/2010 | Masuda | B65H 26/02 156/64 |
| 2014/0274643 | A1 | 9/2014 | Clark et al. | |
| 2016/0361886 | A1* | 12/2016 | Suzuki | B31F 1/2822 |
| 2018/0200906 | A1* | 7/2018 | Senoo | B31F 7/00 493/354 |

FOREIGN PATENT DOCUMENTS

| | | |
|---|---|---|
| CN | 1586882 | 3/2005 |
| CN | 1787897 | 6/2006 |
| CN | 2818131 | 9/2006 |
| CN | 101024314 | 8/2007 |
| CN | 101691076 | 4/2010 |
| CN | 105015040 | 11/2015 |
| EP | 0247300 | 12/1987 |

* cited by examiner

| ID | PI | Job | Job | PI | ID |
|---|---|---|---|---|---|
| 1 | 1 | A | B | 1 | 1 |
| 2 | 1 | A | B | 1 | 2 |
| 3 | 1 | A | B | 1 | 3 |
| 4 | 1 | A | B | 1 | 4 |
| 5 | 1 | A | B | 1 | 5 |
| 6 | 1 | A | B | 1 | 6 |
| 7 | 1 | A | | | 7 |
| 8 | | Order Change | | | 8 |
| 9 | 2 | C | D | 2 | 9 |
| 10 | 2 | C | D | 2 | 10 |
| 11 | 2 | C | D | 2 | 11 |
| 12 | 2 | C | | 2 | 12 |
| 13 | | Order Change | | | 13 |
| 14 | 3 | E | A | 3 | 14 |
| 15 | 3 | E | A | 3 | 15 |
| 16 | 3 | E | A | 3 | 16 |
| **17** | **3** | **E** | **A** | **3** | **17** |
| **18** | **3** | **E** | **A** | **3** | **18** |
| **19** | **3** | **E** | **A** | **3** | **19** |
| **20** | **3** | **E** | **A** | **3** | **20** |
| **21** | **3** | **E** | **A** | **3** | **21** |
| 22 | 3 | E | A | 3 | 22 |
| 23 | 3 | E | A | 3 | 23 |
| 24 | 3 | E | | 3 | 24 |
| 25 | | Order Change | | | 25 |

| ID | PI | Job | Job | PI | ID |
|---|---|---|---|---|---|
| 1 | 1 | A | B | 1 | 1 |
| 2 | 1 | A | B | 1 | 2 |
| 3 | 1 | A | B | 1 | 3 |
| 4 | 1 | A | B | 1 | 4 |
| 5 | 1 | A | B | 1 | 5 |
| 6 | 1 | A | B | 1 | 6 |
| 7 | 1 | A | | | 7 |
| 8 | | Order Change | | | 8 |
| 9 | 2 | C | D | 2 | 9 |
| 10 | 2 | C | D | 2 | 10 |
| 11 | 2 | C | D | 2 | 11 |
| 12 | 2 | C | | 2 | 12 |
| 13 | | Order Change | | | 13 |
| 14 | 3 | E | A | 3 | 14 |
| 15 | 3 | E | A | 3 | 15 |
| 16 | 3 | E | A | 3 | 16 |
| 17 | 3 | E | A | 3 | 17 |
| 18 | 3 | E | A | 3 | 18 |
| 19 | 3 | E | A | 3 | 19 |
| 20 | 3 | E | A | 3 | 20 |
| 21 | 3 | E | A | 3 | 21 |
| 22 | 3 | E | A | 3 | 22 |
| 23 | 3 | E | A | 3 | 23 |
| 24 | 3 | E | | 3 | 24 |
| 25 | | Order Change | | | 25 |

Fig. 12

| ID | PI | Job | Job | PI | ID |
|---|---|---|---|---|---|
| 1 | 1 | A | B | 1 | 1 |
| 2 | 1 | A | B | 1 | 2 |
| 3 | 1 | A | B | 1 | 3 |
| 4 | 1 | A | B | 1 | 4 |
| 5 | 1 | A | B | 1 | 5 |
| 6 | 1 | A | B | 1 | 6 |
| 7 | 1 | A | | | 7 |
| 8 | | Order Change | | | 8 |
| 9 | 2 | C | D | 2 | 9 |
| 10 | 2 | C | D | 2 | 10 |
| 11 | 2 | C | D | 2 | 11 |
| 12 | 2 | C | | 2 | 12 |
| 13 | | Order Change | | | 13 |
| 14 | 3 | E | A | 3 | 14 |
| 15 | 3 | E | A | 3 | 15 |
| 16 | 3 | E | A | 3 | 16 |
| **21** | | **Splice** | | | **21** |
| 22 | 3 | E | A | 3 | 22 |
| 23 | 3 | E | A | 3 | 23 |
| 24 | 3 | E | | 3 | 24 |
| 25 | | Order Change | | | 25 |

Fig. 13

Intelligent mark. Contains positional reference relative to Reel Map created on digital press or Reel Editor.

CORRUGATED SHEET PROCESSING APPARATUS

The present invention relates to a corrugator process control system and a sheet processing apparatus. The system helps to automate the synchronisation between printed surfaces of a printed sheet media, such as a corrugate, with downstream processes, such as cutters, creasers, folders and perforators, so that printed products can be correctly formed or cut from the printed sheet. The system can alternatively or additionally facilitate stock control or error correction in respect of media failures or mis-feeds.

It is common to apply a printed image onto corrugated sheets or webs before they are cut into individual, separate products or blanks, and the printing can be either or both on a top and bottom sheet or layer thereof. However, ensuring a correct registration of product images with the final shape of the products or blanks can be a challenge.

Registration indicators, including lines along the edges of the webs, have been used for the purpose of assisting with the correct registration. These indicators are often printed onto waste areas of the printed sheet, usually at the same time that the product images are printed so that they correctly register with the product images. These registration indicators then enable the downstream control processes to correctly register the downstream sheet processing apparatuses, such as cutters, scorers, gluers, perforators or folding mechanisms, with the image. Further, as they are commonly on a waste area, the registration indicators will not be present on the final cut product—they get cut out when the waste area is removed. However, the indicators might instead remain visible, e.g. if desired for a subsequent quality control inspection on the products.

The printed images are commonly printed onto a separate top sheet (or bottom sheet), such as onto a bulk roll, e.g. a kraft paper roll, off-line, for incorporation onto a base or carrier, such as a corrugated sheet, or a component layer thereof, within a combiner unit or corrugator, with the products or blanks then being cut from the resulting composite printed sheet media, often a corrugate, downstream of the combiner unit (or corrugator). See, for example, FIG. 2 for a schematic illustration of a single layer corrugator. FIGS. 16, 17, 18 and 19 show further schematic examples.

Developments have also contemplated direct printing onto the base or carrier, and thus the corrugator may have a printer incorporated therein. The issue of registration of the image with the cutters, etc., however, can still remain either way.

A common approach used in the prior art for off-line printing is rotary screen printing. Rotary screen printing machines can print multicolour images, usually of a limited palette number, onto an unrolled sheet of paper prior to then rolling the sheet back up again ready for transportation to a subsequent sheet processing apparatus, such as the above combiner unit or corrugator, when the products are to be processed therefrom. See FIG. 1 for a schematic view of such a printing process. Such printing machines can operate at fast sheet-feed speeds, such as speeds in excess of 100 metres per minute (100 mpm), and in many circumstances at speeds in excess of 200 mpm, or even 300 mpm. These printers can also readily operate, and with a print width in excess of 2 metres, 2.4 m, or even 2.8 m. Drawbacks with rotary screen printing, however, include the inability to vary or change the image during a print run, and the lack of a wider colour palette. Different images, and thus different products, can be presented across the width of the sheet, but as the images correspond to the surface forms provided on a screen print inking roller 110 (or a further roller engaging therewith, either directly or indirectly via further rollers), and since that roller has a fixed circumference, the periodicity or length of the repeating images produced thereby must inevitably align with the length of that circumference along the web (either singly or in multiples). As a result, the printed images formed with these printers tend to form aligned arrays with a common longitudinal period, such as that shown in FIG. 3, with only limited scope for variance across the widths of the web.

Given the desire to produce a more variable product output, however, alternative methods of printing have also been explored, including digital printing. This has opened up the possibility of varying the images along the length of the sheet in addition to along its width. It also opens up the possibility of varying the periodicity of the images along the length of the sheet—the circumference of a roller is no longer a factor in the image design, or print layout. As a consequence, printed images along the lines of those shown in FIGS. 4, 5, 6 and 7 have become achievable.

The developed printing techniques are explored in an earlier application by the present applicant, published as EP2551117, and it considers the use of either a single printer unit or multiple printer units, actually within the sheet processing apparatus or corrugator. The entire contents of this earlier application are incorporated herein by way of reference.

Managing the downstream processing of these printed sheets, such as the cutting, scoring or folding of the blanks formed therewith, however, remains difficult as the shapes of the images, or the shapes of the blanks to be cut from the sheets incorporating the images, vary from one order/run to another. That processing can be made even harder to achieve when the form of the corrugate needs to alter between the orders as that requires alterations at the wet end—be it in the form/shape of the corrugates, or the form/type of the component sheets or glue, or any surface treatments thereof.

It is also important to note that these sheet processing apparatuses or corrugators can run at commercially appropriate sheet throughput speeds to allow many hundreds of products to be produced where needed in a relatively short period of time. For example, some commercial corrugators operate at sheet feed speeds in the order of 50 to 400 metres per minute, whereby 10 s or 100 s of product images may be presented for processing every minute. As a consequence any changeover or down time is undesirable—it presents a period of time where products are not being produced. Such changeover or down time, however, will remain inevitable even with the present invention. An aim, therefore, is to reduce the changeover or down time.

A further aim is to facilitate a quicker or simpler adoption of shorter product runs—preferably sequential product runs even of changing product sizes.

Processing of differing product/images can be made even more challenging when a sheet has multiple lanes of product images across its width. FIG. 4, for example, shows four such lanes, and FIGS. 6 and 7 show three.

The present invention therefore looks to provide a control system, and a print form, whereby downstream processing of printed media, such as cutting, scoring, perforating or folding, or the integration/lamination thereof into or onto one or more other sheet or web, can be both accurate and adaptable so that sequentially different products can be processed efficiently—and optimally with less waste. After all, excessive waste or slow changeover times can be detrimental to the profitability of a product run, a more apparent factor with short product runs given the relatively fixed unit cost of time and paper, and that cost's greater loss per sales value ratio with shorter product runs.

According to a first aspect of the present invention there is provided a corrugated sheet processing apparatus comprising:

a control system; and downstream processing equipment, the downstream processing equipment comprising at least feed and guide rollers for moving or supporting a corrugated sheet and at least one cutting apparatus for cutting products from the corrugated sheet;

wherein:

the control system is for controlling at least the cutting apparatus;

the sheet processing apparatus further comprises a visual inspection unit arranged for reading printed information markers provided on the corrugated sheet as the corrugated sheet, and thus the printed information markers to be read, pass through the corrugated sheet processing apparatus past the visual inspection unit: and the control system further has a data look-up table comprising at least information associated with the products to be cut from the corrugated sheet, including cutter settings for the at least one cutting apparatus for those products, and associated with those settings specific identifier information readable from the printed information markers by the visual inspection unit, whereby the apparatus can identify required cutter settings for the cutting apparatus for the read printed information markers so that the cutting apparatus can be appropriately controlled by the control system in response to a read printed information marker to provide a change in the cutter requirements.

With this system, a need to change cutter requirements for a particular product run can be identified in advance of the need (as the sensor can be mounted upstream of the cutting apparatus), which identification can then be reacted to by the control system in a timely fashion, and this is done simply and efficiently via a reading of printed information markers on the corrugated sheet, rather than necessitating operator intervention.

Preferably the control system, or a secondary control system, controls the feed rollers. Preferably when a need to change is identified, the control system causes the feed rollers or the apparatus as a whole, to reduce its speed of operation as the relevant part of the web or sheet approaches the cutting apparatus, thus offering a longer time period for effecting the change in the cutter settings when the need arises. This is beneficial as often there needs to be mechanical movements of the cutters of the cutting apparatus, and that inevitably takes some time—it cannot be instantaneous.

A further aspect of the present invention may have this speed control being activated instead of the cutter control, i.e. in response to the reading of the markers. This can have particular benefits for the second aspect of the present invention.

According to the second aspect of the present invention there is provided a corrugated sheet processing apparatus for a corrugator comprising:

sheet processing equipment comprising at least feed and guide rollers for selecting, moving and supporting sheets or webs to the corrugator for forming a corrugated sheet from which corrugated products can be cut, at least one layer of the corrugated sheet, and thus products, being formed from a printed sheet or web; and a control system for controlling the sheet processing equipment;

the sheet processing apparatus further comprising a visual inspection unit arranged for reading printed information markers provided on the at least one printed sheet or web as the printed sheet or web, and thus the printed information markers to be read, pass through the corrugated sheet processing apparatus, or corrugator, past the visual inspection unit; and wherein the control system further has a data look-up table comprising for the products at least information associated with the form or type of at least one of the sheets or webs to be used in the corrugated sheet for those products, and associated with that information specific identifier information readable from the printed information markers by the visual inspection unit, whereby the apparatus can identify what products will be produced downstream of the visual inspection unit, and the required settings for the sheet processing equipment or corrugator for those products, from a read printed information marker so that the sheet processing equipment or corrugator can be appropriately controlled by the control system in response to the read printed information marker.

Preferably the control system enables automated changes in at least one of a) the feed speeds of the sheets or webs, b) the number of sheets or webs being fed, and c) the source roll or rolls from which one or more of the sheets or webs is fed. The control system may additionally, or instead, control the glue type, glue temperatures, glue thicknesses or glue locations.

Preferably the control system can automate a timing of a change, such as in the number of sheets or webs being fed, or the source roll or rolls from which one or more of the sheets or webs is fed, or of some other feature of the corrugator or sheet processing equipment, to allow the corrugated sheet formed in the corrugator to change within the material stream so as to alter from one form to another, i.e. such that it can be altered to have a form, or a type of sheet or web therein, that matches a requirement set out in data look-up table for the product to be cut therefrom.

Preferably sheet processing equipment includes at least one splicing unit.

Preferably, upon noting a forthcoming requirement change by reference to the look-up table, and when an appropriate different source roll (for a changing required form or type for the at least one sheet or web) is already loaded into a splicing unit of the sheet processing equipment, the control system and the sheet processing equipment operate to switch out a first source roll and splice in the different source roll, so as to achieve a change in the material input for the corrugator. This switch will be for meeting the requirements in respect of the type of sheet or web required by the requirement change.

Preferably the sheet processing equipment is arranged to operate the switch within the splicing unit within 10 seconds of noting the requirement change. Instead of 10 seconds, the switch may be triggered within a linear distance of travel of the sheet materials of 10 m, i.e. such that the switch is done by the time that the read information marker that noted the requirement change has moved further through the apparatus by no more than 10 m. Instead of 10 m, it may be 5 m, or it may be slower, e.g. 20 m or 50 m.

It may be preferred that when a requirement change is noted, the sheet processing apparatus, and the corrugator, slow down, thus facilitating the switch with reduced wastage in the event of sheet-overrun. For example, the corrugator may operate at peak material stream speeds of between 200 and 400 m per minute, but may slow to between 20 and 100 m per minute when a changeover is needed.

Most preferably, splicing in of a different web or sheet can be achieved within a material feed distance of no more than 20 m, e.g. between 1 and 20 m.

The invention can anticipate the requirement change for the properties of the corrugate in advance of the cutting of the product from the corrugate by knowing where in the roll (or where in a print job) the currently inspected information marker is from, and thus by knowing how many more products are to be produced (after that information marker location). The requirement change—e.g. for the next product design, can thus be implemented in a timely manner—to coincide with the commencement of the next product run.

Preferably the sheet processing equipment comprises a splicing unit for each layer of the corrugated sheet, such that the properties of each layer is independently switchable.

Preferably the sheet processing equipment can also affect a reduction (or increase) in the number of layers within the corrugate in a similar time frame (or sheet-feed distance). The apparatus will thus have a variably multi-ply capacity, or a single ply capability. The apparatus or corrugator is thus then able to produce a wider range of corrugated sheet requirements, each being switchable between on the fly.

The control system, by referencing sheet or material requirements from the data look-up table, and also by knowing the current position of the printed sheet by reference to the data of the information marker, can thus provide sequential product runs (jobs) from a singular printed sheet with minimal (or no) downtime between jobs, where either the cutting requirements change (the first aspect) or even where the properties of the corrugated sheet needs to change between jobs (the second aspect), and these are achieved by the controlled coordination of the timing of the cutting, the form of the cutting or even the splicing in (or out) of the component sheets of the corrugated sheet itself, or via other control of the corrugator, all in response to tracking the printed sheet via the printed information markers. After all, the positional data of the printed sheet becomes discernible from the specific identifier information of the printed information markers on the printed sheet or web.

To allow for the likely waste product generated during any changeover in the corrugated sheet's structure, such as through the splicing operations, and also to allow for possible downstream wastage through tears or creasing, it is preferred for any print run for a particular product job, that between 0.5% and 4% more product images are generated in the print run for that printed sheet than are required by the customer. As a consequence, any wastage or sheet imperfections occurring during a requirement changeover typically will not result in a need for repeat printing of the printed images that were present in that waste material.

For each aspect, it is preferred that each printed information marker is a QR code or bar code and the visual inspection unit includes an appropriate reader therefor. The marker may even be a unique coding or encrypted marker—either a stand-alone marker or a marker encrypted into the image for the product.

The apparatus of the invention may incorporate both the first and second aspects, which may thus then operate together, off the same information markers and the same (more comprehensive) data look-up table.

Preferably the look up table is a reel map. A reel map has all the data needed for the print jobs on a particular roll of printed media. It allows the apparatus to determine where on a reel the feeding sheet is from purely from an analysis of the information marker, and thus it can allow anticipation of changes—i.e. it foresees an approaching change requirement. This foresight can also be highlighted early to an operator to allow an appropriate roll change to be made (if a wrong source roll is in the relevant splicing unit), thus potentially further reducing downtime.

Preferably each marker is uniquely identified by its printed information whereby its position within a particular order can be ascertained. A unique identifier for that may include an order number and serial number, and possibly some details of the order such as the order quantity—i.e. the number of products to be made for completing the order, although the latter may be provided by the look-up table.

Preferably the marker is located in a waste portion of the corrugated sheet—it thus gets cut off the product by the cutting apparatus (or by a subsequent cutting apparatus if later trimmed).

Preferably the corrugated sheet also comprises printed images on at least one of its surfaces for appearing on the surfaces of the final products. Preferably the printed images do not overlap the printed information markers.

Preferably the corrugated sheet includes a plurality of printed images and an associated unique printed information marker for each of those printed images.

The printed images are preferably the images to be present on an outer surface of the final products, although they may be smaller than that surface, or larger than it—with the latter arrangement then having part thereof trimmed or cut away during the cutting of the final product.

The smaller version can likewise be trimmed, but only if not all of it is to be present on the final product.

Preferably the printed images represent the images for at least two different product orders, the two different product orders being sequentially positioned longitudinally along the length of the corrugated sheet or web. Generally the separate orders are somewhat spaced apart—e.g. by a distance equating to perhaps 3 to 20 image or product lengths, to give a cutting apparatus a change-over buffer period as the sheet passes through the apparatus.

It is possible that sequential orders are not all printed, so some orders with printing may follow other orders without printing. As such the printed image is not essential, although the markers can still be provided for assisting with the tracking of order positions within a web or roll of sheet material.

Another arrangement may have only some of the printed images having an associated unique printed information marker—for example, where there are many hundreds of identical products to be made, each individual product may not need a unique identifier.

Having a marker for each image gives a more accurate identification of where in the order the corrugated sheet is at whenever a marker is read, but operations may not need to be quite as precise as identifying each individual product or image within in that order. An example here might be that a unique identifier is provided every fourth image. Therefore, preferably at least 25% of the printed images are associated with an adjacent or coincident printed information marker.

Preferably the corrugated sheet processing apparatus comprises a corrugator. The printed information markers might then be provided on a cover sheet for combining onto a corrugated sheet by the corrugator.

Preferably the corrugated sheet processing apparatus has at least three sheet input rolls, including a top sheet, a bottom sheet and a sheet for corrugating therebetween, all for feeding into the corrugator.

The apparatus may comprise a digital printer adapted to print a surface of either the corrugated sheet, or a readable one of the sheet input rolls' sheets with the printed information markers and, where provided, the printed images. More usually, however, the printed information markers, and the printed images where provided, are pre-printed onto a web and rewound onto a roll, for later feeding into the corrugated sheet processing apparatus.

The cutting apparatus generally comprises more than one cutting blade for providing more than one different cuts.

Preferably the cutter includes one or more longitudinal cutting unit or blade, such as a rotary blade cutter, for cutting the corrugated sheet lengthways into two or more separate lines.

Preferably the cutter includes one or more cross-cut cutting unit or blade, such as a shear blade, for cutting at least part way across the corrugated sheet, for example to form distinct stackable units, each of which may be, or each of which may comprise, at least one product. This may be done before or after the operation of a longitudinal cutting unit or blade, where provided.

Preferably the corrugated sheet is at least 2 m wide.

Preferably the corrugated sheet is only corrugated from a certain part of the apparatus, a corrugator upstream thereof forming the corrugation, and upstream of the corrugator the sheet being multiple distinct webs.

Preferably the corrugated sheet is arranged to travel through the apparatus at a peak speed in excess of 100 metres per minute (mpm), and more preferably at a peak speed of more than 200 mpm, or even more than 300 mpm.

Preferably the apparatus comprises one or more cross-cut apparatus adapted to cut the corrugated sheet into a predetermined length to form lengths for stacking. The lengths may have a length (measured in the corrugate sheet's travel direction within the apparatus (the longitudinal direction) corresponding to the length of the final products or blanks being cut by the apparatus. This length can vary between sequential orders (and where orders are processed side by side, between concurrent orders—where the corrugated sheet is first processed into separate lines, e.g. by a longitudinal cutter. These lengths can then be stacked, or cut to width (if needed and not already done) before being stacked, for removal from the apparatus—e.g. after baling.

The stacked products can then later be further processed, e.g. folded or filled (if the product is a blank for a box or tray), or perforated or scoring (if needed and not yet done), or delivered to the customer if the customer's requirements are complete.

The predetermined lengths can be part of the information on the marker, but more typically it will be part of the information retained in the look-up table. The width can likewise be part of the information on the marker, but again is more usually part of the information retained in the look-up table. Either way, the markers can allow the reader and then the control system, to instruct (or confirm) the appropriate control of the cutting apparatus.

Preferably the corrugated sheet is made of card or paper.

The lengths of product, e.g. cardboard, or the distinct stackable units, may exit the apparatus as an unfinished board ready for final finishing steps in subsequent sheet processing equipment, i.e. subsequent trimming, scoring, folding or gluing, or stapling, or they may be complete to a customer's requirement.

The cutting apparatus will usually additionally include additional cutting blades, or a further cutting apparatus may additionally be provided, to provide further blades or stamp-cutters, to trim waste off preliminarily sized sheets, or to otherwise meet the required product specification.

Preferably the apparatus also comprises any or each of a) scoring equipment, b) perforating equipment and c) folding equipment.

Preferably the corrugated sheet processing apparatus is a corrugated cardboard blank manufacturing apparatus—the output is thus a corrugated cardboard blank.

More than one corrugator may be provided, or the corrugator can comprise more than one corrugation former, for providing a multi-walled corrugated sheet. For this, additional rolls of paper may be needed—i.e. more than the three needed for a single corrugation.

The apparatus may comprise laminating equipment, e.g. for laminating a printed cover sheet onto a backing sheet, the printed cover sheet then being a fourth or top/bottom sheet layer of the corrugated sheet.

The printed markers (and images where provided) represent runs or orders of product, and sequential runs or orders can be provided on a continuous reel, usually having been printed thereon using a digital printer, whereby the images, and product sizes, can change along a roll. Alternatively different orders can be spliced into the production line (sequential print runs can be spliced by feeding a subsequent job into the loading end of the processing equipment as a preceding job is being finished, although this process usually entails considerable material wastage (due to the change-over process), and also considerable operator-machine interaction at the time. To be able to minimise splicing operations by having varying orders in a single roll, wastage and operator input time can be reduced.

Another way of saving such time and waste is to run separate orders side by side from a common roll, whereby a width of the media may comprise two or more different images, each representing one product of two separate orders. This is best achieved by using a digital printer. Different cutting requirements may prevail, and further different paper weights may be needed by the corrugator, but those corrugate layers can be separately spliced into the production line, e.g. under a continuous printed top layer.

A further aspect of the invention looks to minimise the number of waste areas, or frequency of paper weight changes.

According to a second aspect of the present invention, therefore, there is provided an print layout arranger and printer, the arranger being for generating an organised print layout for the printer and the printer being for printing a sheet of paper from a roll with the print layout thereon, the layout comprising a plurality of printed images for a plurality of products, the products comprising products of a plurality of different orders, the products of at least some of the orders having different sizes either or both in terms of their length or width, wherein the arranger chooses the orders for the layout from a catalogue of orders greater in number than the number of the plurality of orders on the layout, each order in the catalogue of orders comprising associated data including a length and width of the product and at least one desired or permitted corrugate specification, the arranger choosing for the layout those orders having a common desired or permitted corrugate specification, and setting out on the layout the images for the chosen orders along the print layout, all the images for each order being grouped together at least linearly along the print layout.

In some embodiments, where the widths of the orders permit it, orders can be laid out on the print layout side by side as well as linearly along the print layout. The side by side orders are preferably different orders, especially where two or more different order widths can be determined better to fit the width of the roll than two or more products of the same order.

Preferably each order has an image for printing on the sheet of paper. However, orders not requiring printing can also be accommodated within the catalogue—thus increasing the number of orders to select from for the layout.

Preferably at least some, if not all, of the laid out products have an information marker printed next to or within it. The information marker allows the printed paper to be used by the apparatus of the first aspect of the present invention. Preferably it is printed in a trim area such that it will be trimmed off the product before distribution to a customer.

With this further aspect of the present invention, the printed roll is preferably one of the rolls used to form the corrugated sheet within the apparatus of the first aspect of the present invention.

Preferably the printer also re-rolls the sheet into a roll—e.g. for later use in a corrugator, such as the above apparatus.

Preferably the paper comprises at least one layer of printed kraft paper.

With the apparatus of the first aspect of the present invention, different sheet materials, or different sheet weights, and variations in surface treatments thereof, can be used as desired for forming the desired final corrugated sheet. For example, a top sheet may be a different material or weight to a base sheet, or the or each corrugated layer may be different to top and bottom (and middle/other) layers. The choice of the materials, weights and surface treatments for the various layers enables the material properties of the finished article to be controlled.

It would be desirable to provide the digital printer such that it extends as a single unit across the full width of the roll of paper.

Alternatively, at least two digital printers can each be arranged to extend across at least part of the width of the sheet. This may enable a faster sheet-feed speed past the printers.

The printers may be arranged in an aligned manner such that they lie end to end, or they may be arranged in parallel to one another, but displaced out of line of one another, potentially with overlapping ends—there will then be a reduced (or no) portion therebetween on which neither printer can print.

The use of two digital printers, arranged substantially end-to-end (be that in an aligned form, or in a relatively displaced form, as discussed above) allows substantially the full width of the web, or even the entire width, to be printed upon, even at high sheet-feed speeds such as 50-300 mps, whereas a moving-head single printer might not be able to achieve such speeds on a wide format sheet—one over 2 m wide.

In addition to the ability to print different jobs side by side, digital printers allow multiple colours to be printed at these high speeds and for a print run to have continuously (sequentially) varying detail(s) thereon, such as the information markers, or serial numbers, for uniquely identifying each printed product, or, as with the information markers of the present invention, for identifying details of the order. Screen print rollers typically need to print the same image repetitively, thereby making it difficult to provide serial numbers on the printed image, although mechanisms exist for printing sequential serial numbers using screen printing.

According to a third aspect of the present invention there is provided a roll of printed sheet media comprising a rolled sheet of material, the roll having a diameter of at least 300 mm (before unrolling) and a width of at least 1 m, and the rolled sheet having extending along a substantial part of its length, on at least one surface thereof, a plurality of printed images representing the images for surfaces of at least two different product orders, the two different product orders being spaced longitudinally along the sheet with respect to one another, at least the majority of the printed images having a length of at least 300 mm and being destined for providing a printed covering or surface of a product of its order, wherein at least 15% of the printed images of at least one of the orders are associated with, and adjacent or coincident with, one of a plurality of printed information markers on the sheet, the printed information markers each containing data about the product and the order that the product is a part of, that information including at least an order number or order code and a positional indicator relative to the product within the order, such as a product count. With this data from the marker, the apparatus of the first aspect of the invention can provide its inventive function.

15% allows one in six images of the at least one order to be so associated with printed information markers, or one marker per sheet width if six orders (or six images) are running side by side.

More preferably at least 25% of the printed images of at least one of the orders are associated with, and adjacent or coincident with, one of a plurality of printed information markers on the sheet. This then provides one in four for that order, or one marker per sheet width if four orders or images run side by side. These markers, even where not one per image, still allow the position along the roll to be tracked using the markers. Most preferably, however, each printed image of at least one or each order is associated with, and adjacent or coincident with, one of a plurality of printed information markers on the sheet.

Preferably the diameter of the roll is at least 500 mm, or even at least 1 m, before the sheet is unrolled therefrom.

Preferably the width is at least 1.4 m wide or at least 2 m wide or even at least 2.4 m wide.

Preferably the data is encoded on the marker, for example by it being a QR code.

Preferably adjacent but different printed orders are linearly spaced apart on the sheet, preferably with a maximum spatial separation therebetween corresponding to no more than 10 product lengths (and more preferably no more than 5 product lengths or 2 product lengths). This linear spatial separation allows cutter adjustments to be made by the sheet processing apparatus into which the rolled sheet will be fed. The space is an area of waste.

In an alternative arrangement, the spatial separation may be set according to the timing, and/or distance traveled by the sheet in a given printing time period. For example, that spatial separation is preferably no more than the sheet transit distance that occurs within the printing machine used during a period of 10 seconds, and more preferably a period of 5 seconds or 2 seconds. However, as the feed speed may be reduced during product order changeovers, this measurement may be imprecise and difficult to work in practice. A more definitive distance may thus be preferred, such as at least 1 m, but preferably no more than 30 m, 20 m, 15 m, 10 m, 5 m or 3 m These spatial separations from one print job to the next (the different printed images) are significantly smaller than the waste typically occurring when changeovers are done manually, e.g. using splicing, or by splicing a first printed sheet into the place of a separate printed sheet.

The corrugating machines can already adapt their cutting, creasing or perforating units (and in some instances even their folding units) mid-roll, and relatively quickly, e.g. in 2, 5 or 10 seconds, depending upon the changes required (e.g. to the cutting or creasing or perforating widths and lengths). Some of these changes are just dependent upon the control instruction varying the timing of such cutting, perforating, creasing or folding steps or switching over to alternative cutting, perforating, creasing or folding units in the assembly line. By having markers to allow an automated changeover, the changeover will occur at the correct position, whereby there is little likelihood of a product over-run.

The present invention therefore enables jobs/orders/runs to be switched much more quickly, and with less down-time or material wastage, thus making the production of multiple jobs from a single roll of material both achievable and commercially viable.

It is also envisaged that with digital printing it could take a mere matter of hours between receiving instructions for a job and commencing printing, and perhaps cutting, folding, perforating and creasing of the final blank, since an operating printer can have a print-run inserted into its queue, with that print-run being likewise appropriately indexed and instructed into the sheet processing apparatus' look-up table. Before the present invention, there would inevitably be a much longer time-delay between receiving the order and processing the job—typically days, since the printed sheet had to be printed separately onto a dedicated roll of material, and to achieve that a dedicated screen-print roller had to be produced.

The present invention's enabling of job variations within a single roll will also make smaller jobs much more economical as there would be no need for a whole roll (and screen-print roller) to be devoted to a single job.

Additionally, manufacturers will be able to increase the variety of designs, e.g. for the packaging of their products, without significantly increasing overheads, as a number of designs could all be printed on a single roll with minimal additional cost.

According to a further aspect of the present invention there is also provided a combination of a printed roll and a print roll inventory map, the map comprising a record of the images present on the printed roll, wherein each image has an associated information marker comprising both an order identifier and a position identifier, and the inventory map records a list of both the order identifiers and the position identifiers of those information markers in a sequence matching the sequence found on the printed roll.

The inventory map can be a reel map as described herein.

Preferably, for each aspect of the present invention, the products are product blanks, such as blanks for cardboard boxes or trays or lids. They are thus in a (substantially) unassembled state (i.e. a generally flat, substantially unfolded state).

These and other features of the present invention will now be described in greater detail, purely by way of example, with reference to the accompanying drawings in which:

FIG. 1 schematically shows a prior art rotary screen printing process;

FIG. 2 schematically shows a sheet processing apparatus in the form of a corrugated cardboard making machine;

Figure 8:
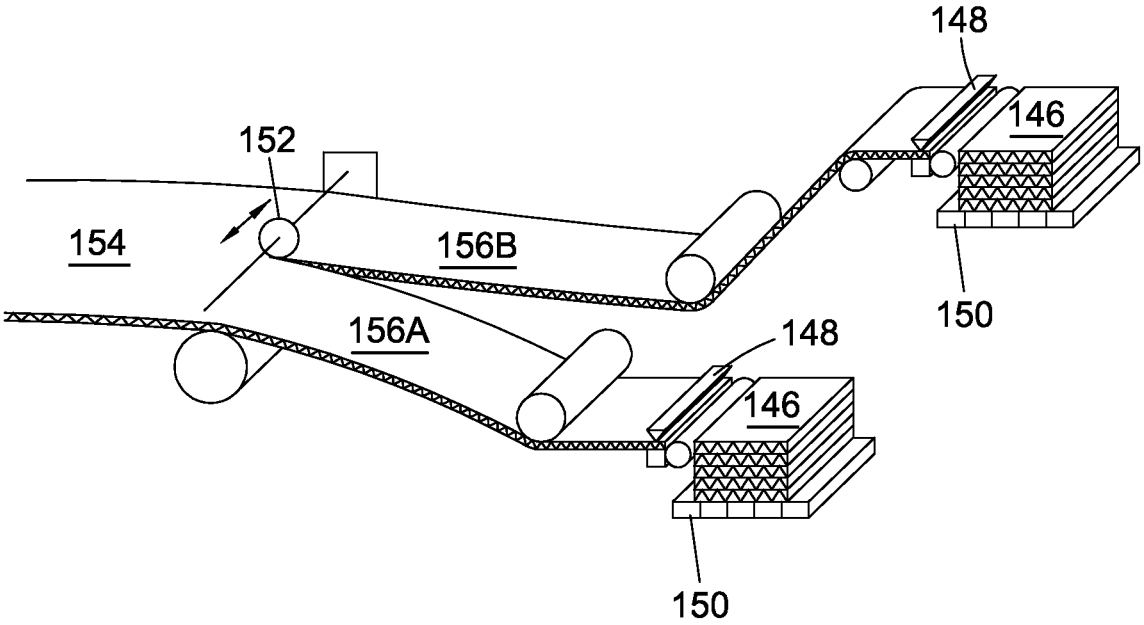
Figure 9:
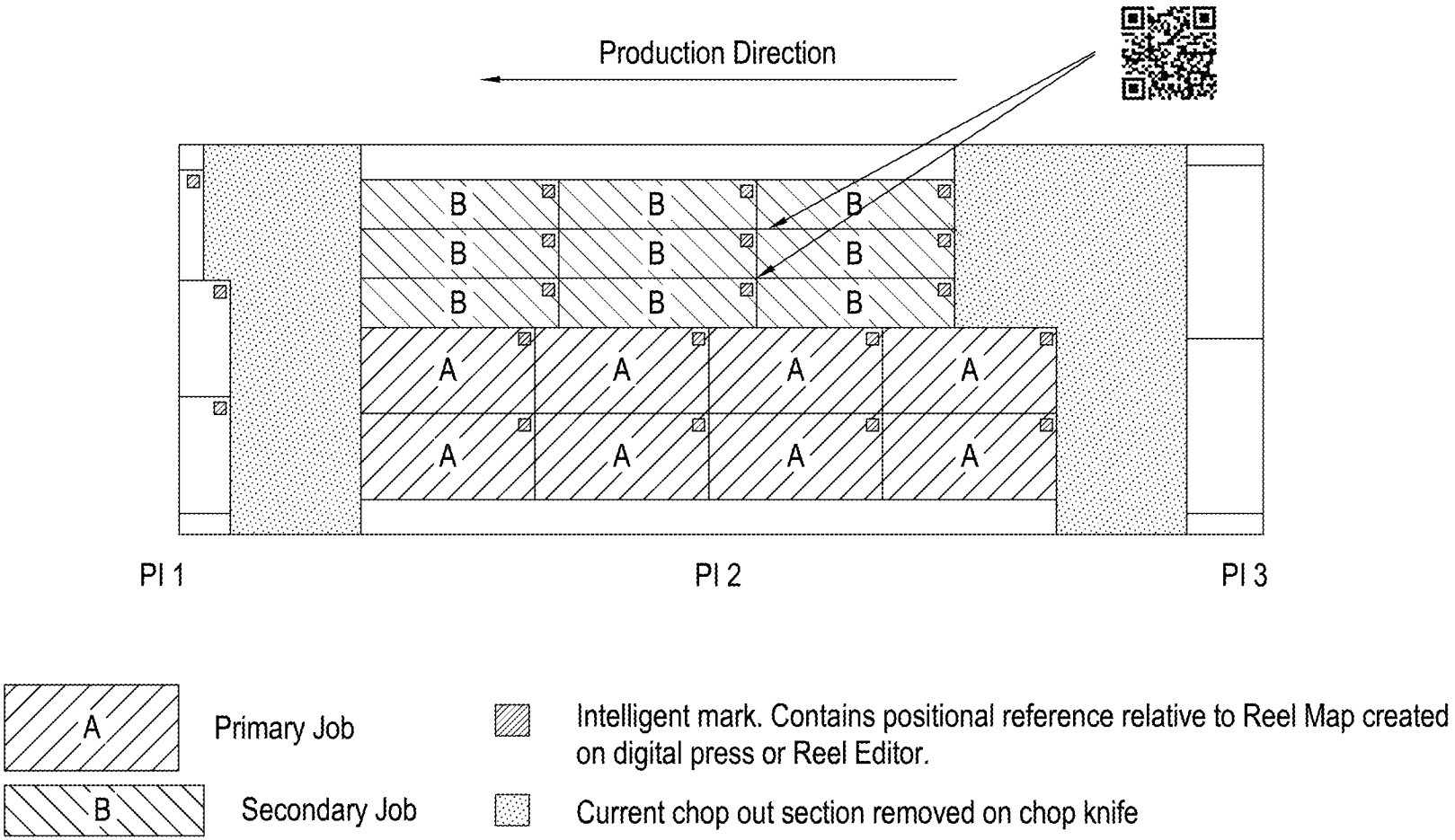
Figures 10, 11:
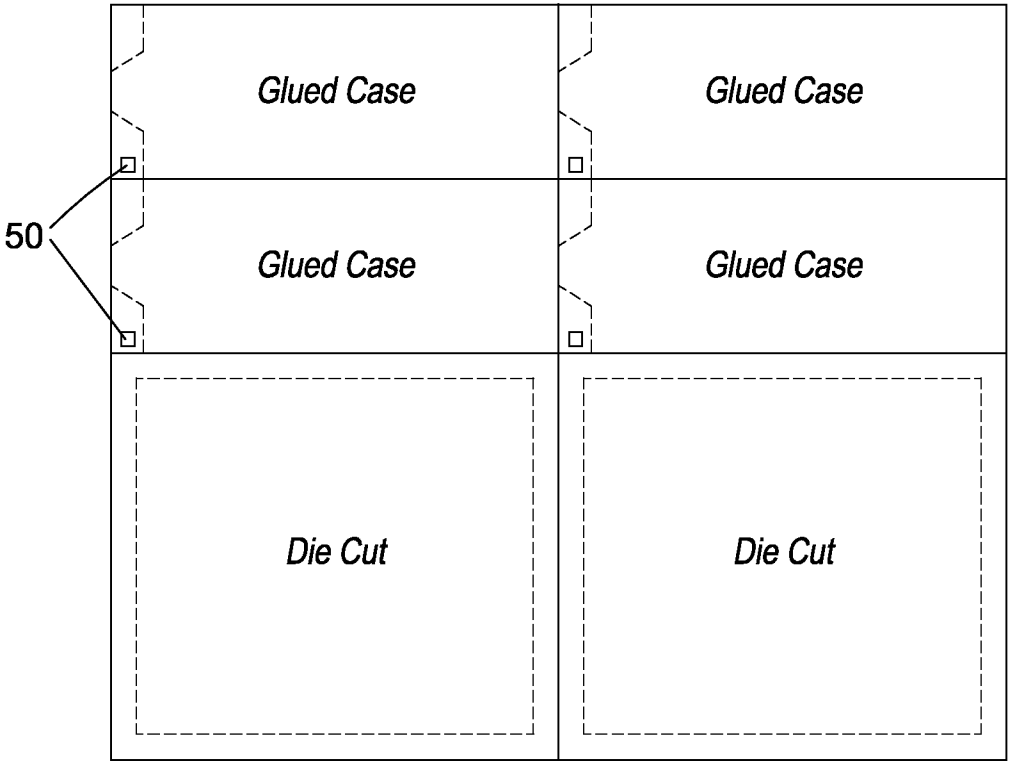
Figure 14:
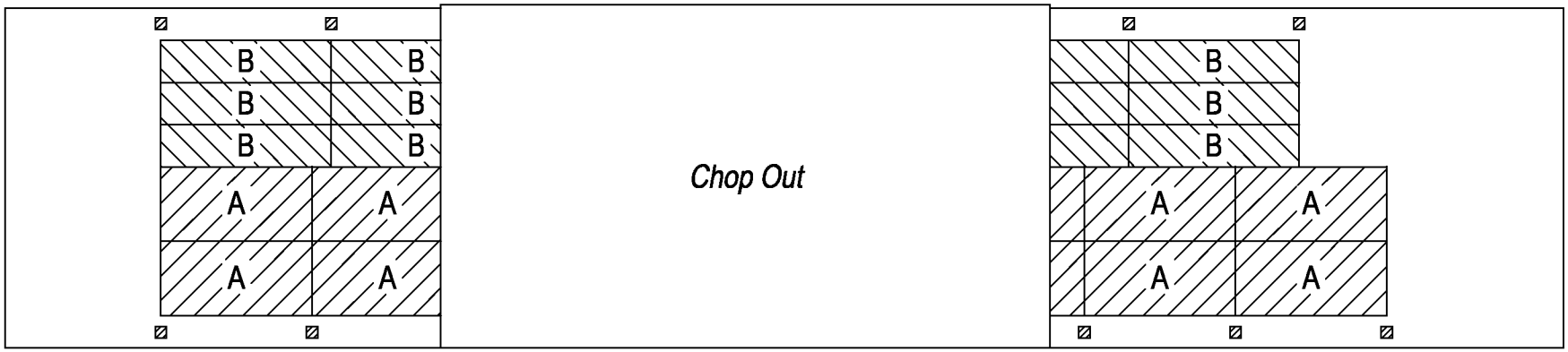
Figure 15:
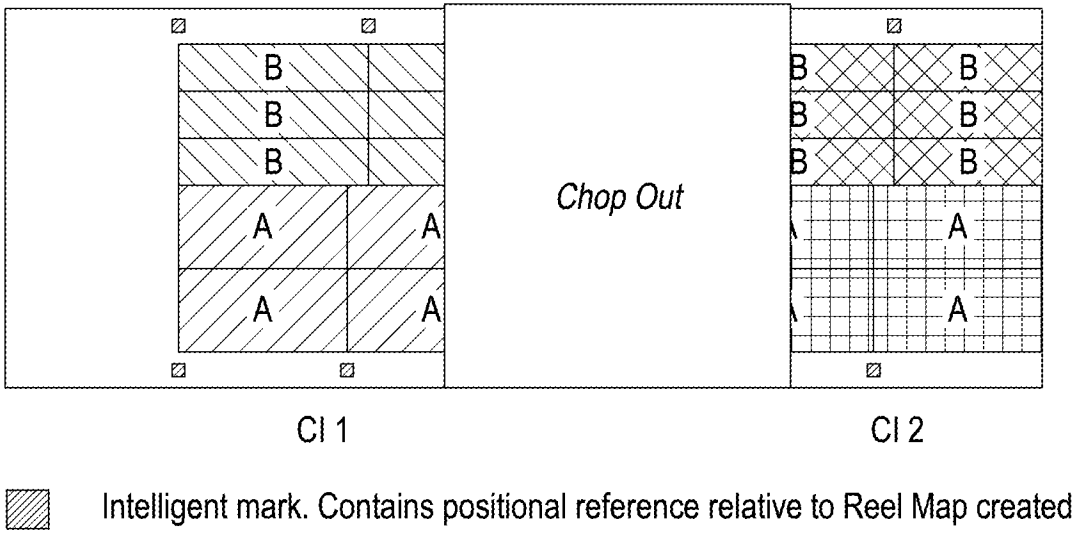
Figure 16:
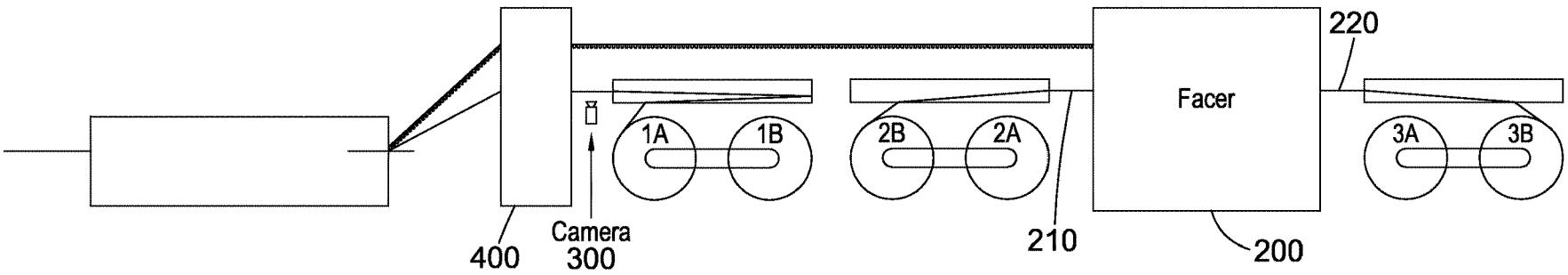
Figure 17:
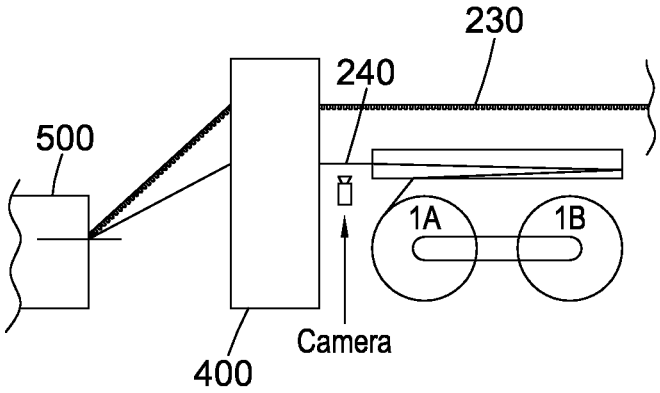
Figure 18:
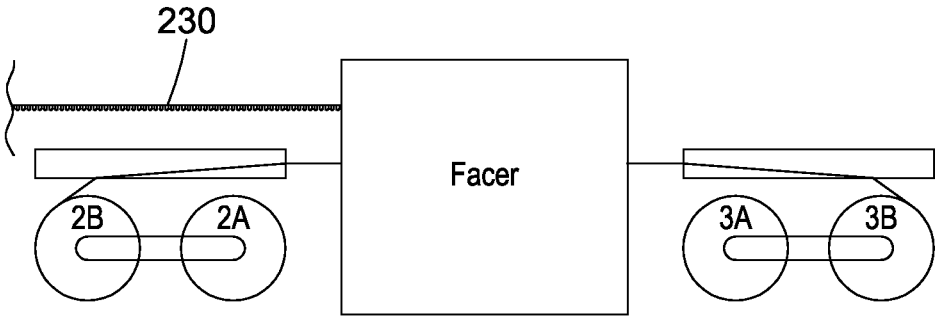
Figure 19:
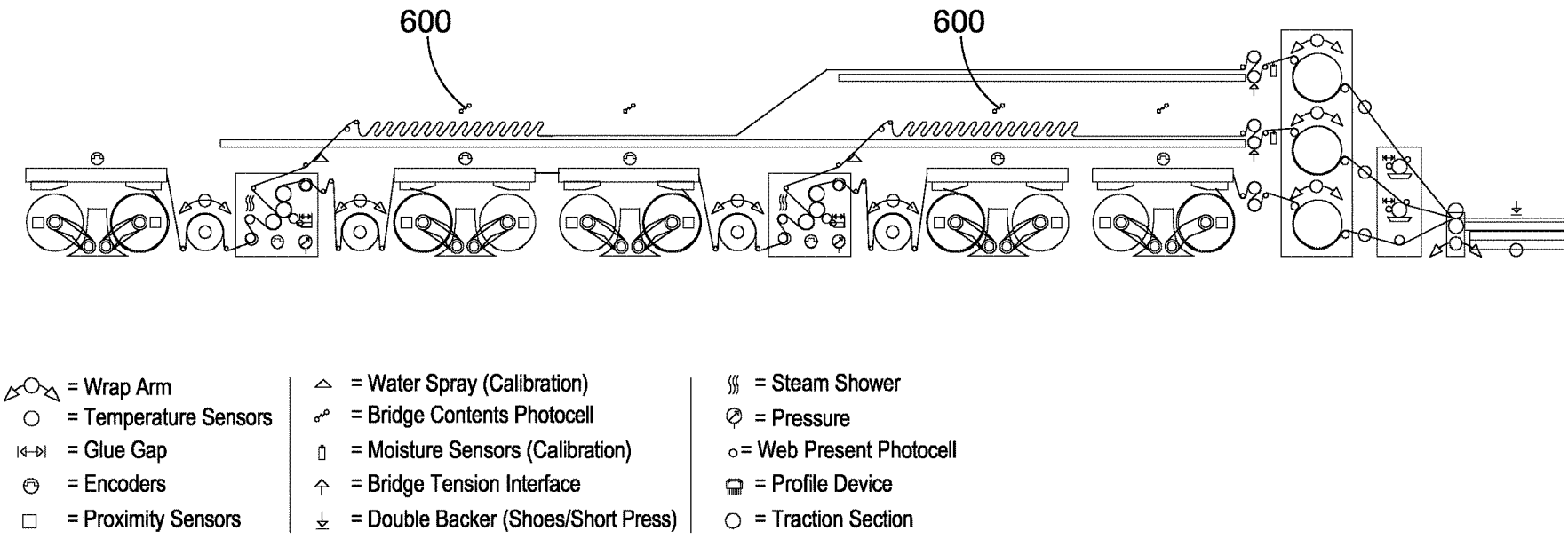
Figure 20:
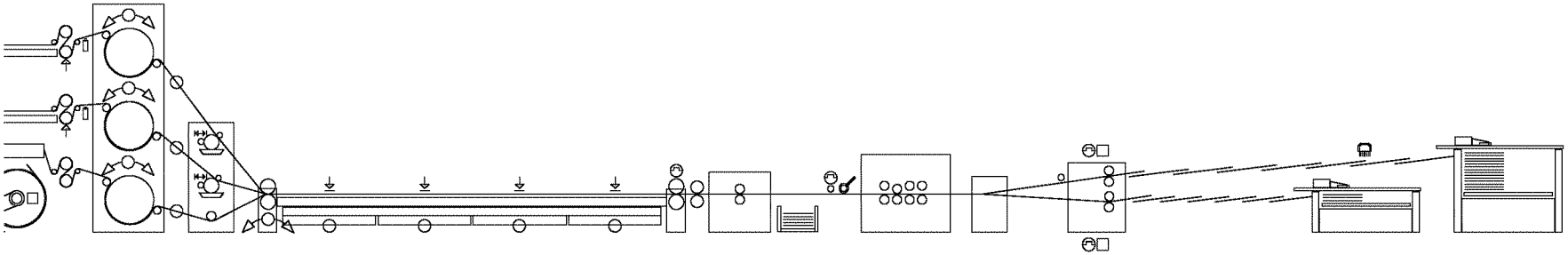

FIG. 8 schematically shows a portion of a sheet processing apparatus wherein the printed sheet media or web is cut into two separate webs, each for separate downstream processing (as herein shown they are cut into stackable sheet products;

FIG. 9 schematically shows a possible form of reel map for representing a section of a printed sheet media—two short product runs are shown in full, and parts of four more product runs are shown at the ends—two at each end (in practice a product run is likely to contain many tens or hundreds of products, rather than the illustrated nine and eight products, respectively, although the present invention does facilitate an efficient production of such short product production runs, if ever desired);

FIG. 10 schematically shows a possible location for printed information markings on a printed sheet—in a waste portion (i.e. a cut-off or trim portion), such as the area surrounding a die-cut product or in the waste area next to glue-tabs;

FIGS. 11 to 13 show an adaptive reel map being updated to form a corrected reel map, such as may occur when a section of a printed sheet from a roll has a detected print error on it (or a tear)—in this instance in ID location 17. The faulty section of the printed sheet may be discarded downstream, or removed and the sheet re-spliced together so that the sheet processing apparatus can still process the roll. For the latter, the reel map is updated to reflect the removal so that the reel map can maintain track of the images actually present on the reel as it passes through the sheet processing apparatus (by following the reel map and checking against data from in-line cameras—on the production line—for conformance);

FIG. 14 shows the reel map adapting to a corrugator or sheet processing apparatus stop event, such as a paper break within a product run;

FIG. 15 shows the reel map adapting to a corrugator or sheet processing apparatus stop event, such as a paper break bridging more than one product run;

FIG. 16 shows a schematic view of a wet end of a corrugate former;

FIGS. 17 and 18 are more detailed views of the apparatus of FIG. 16;

FIG. 19 is a further wet end of a corrugate former showing additional elements thereof; and FIG. 20 shows a dry end of a corrugate former where the corrugated sheets are cut from the continuous stream of corrugate formed thereon.

Figure 2:
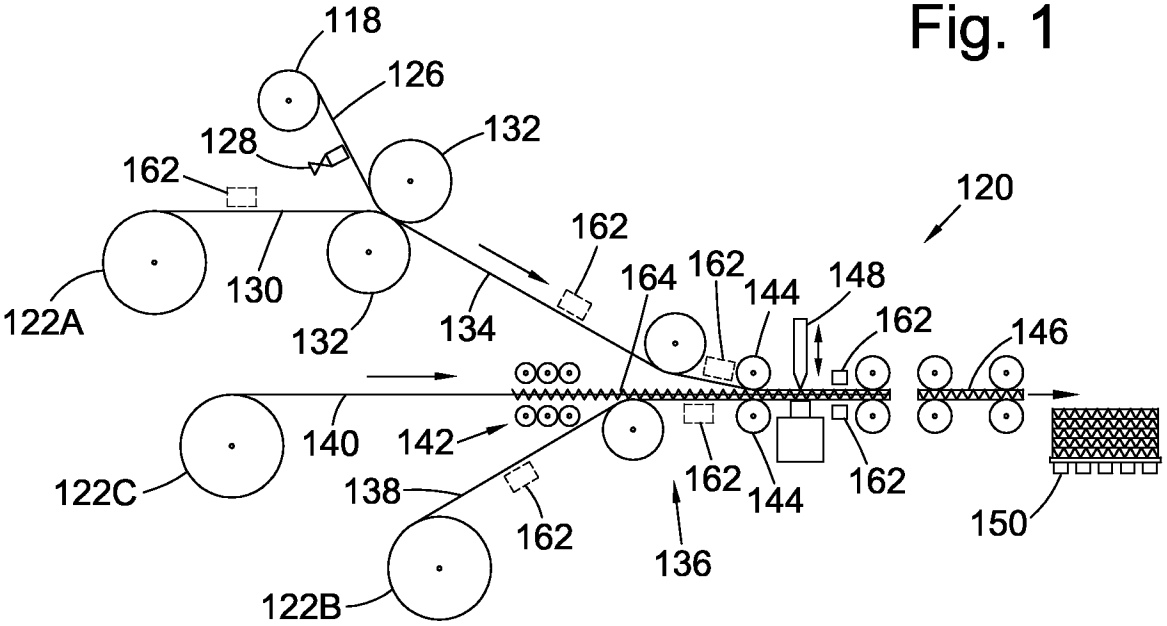
Figure 3:
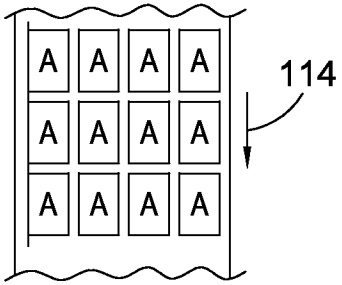
FIG. 3 shows a typical layout of a printed sheet from a screen printing machine such as that of FIG. 1—also producible on a digital printer.

Referring first of all to FIG. 2 there is illustrated an apparatus 120 from which a product 146 can exit or travel at high speed or high frequency, which product 146 features a printed surface. High speed typically encompasses linear transport speeds of over 50 mpm (metres per minute)—the peak feed speed of the webs in the apparatus. These products are cut from a continuous sheet (a corrugated sheet in this embodiment) that is formed therein. This corrugated sheet, also referred to as a printed sheet media, generally has a width of over 600 mm, and most typically a width of more than 1 m, or 1.5 m, or 2 m or 2.4 m.

Figure 1:
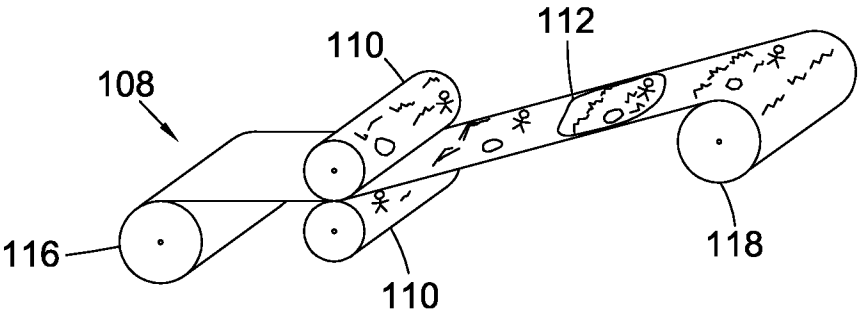

The printed sheet media of that embodiment has a printed top sheet or web 126. The printed top sheet can be produced off-line, i.e. at a separate process station, such as in a rotary screen printing machine 108 as shown in FIG. 1. However, for implementing the advantages of the present invention it will typically be digitally printed by a digital printer (or multiple digital printers)—so that information markers, or varying images, can be provided.

The off-line printer will typically print the required product's images 112 onto a surface of the web 126, and then a laminating process joins the printed web 126 to a surface of a second sheet 130—one that is used to form the product 146*s*. See FIG. 2. This basic operation, when using screen printers, is a common process in the production of corrugated cardboard products. Adding digitally printed images or information markers, however, is a new development of the present invention.

The easiest way to add these new images or information markers is with digital printers. They offer greater flexibility in that they allow a wide variety of output images A, B, C, D on a single roll, as can be seen in FIGS. 4, 5, 6 and 7. In particular, the images on a single roll can have a wider variety of widths and lengths—there is no need to be tied to the size and form of a screen print roller.

Referring again to FIG. 2, the corrugated cardboard manufacturing apparatus 120 takes four webs 126, 130, 140, 138 and combines them into a corrugated printed sheet media having a single corrugated layer and an uppermost printed web 126. As described above, that top web is unraveled off an output roll 118 that has previously been processed by a printing machine 108, such as a digital printer 166 as shown schematically in FIG. 4, 5, 6 or 7, or potentially a rotary screen printer as shown schematically in FIG. 1.

The three lower webs 130, 140, 138 are also each unraveled off a respective roll 122A, 122B, 122C. These webs are generally unprinted.

Being ultimately for forming corrugated cardboard, it is generally the case that these four rolls will all be in the form of paper, and usually kraft paper.

The three lower webs are arranged in the machine 120 such that an uppermost one 130 forms an upper wall of the corrugated cardboard structure, a lowermost one 138 forms a lower wall of the corrugated cardboard structure and a middle web 140 forms the corrugated core 164 of the corrugated cardboard structure. The web 126 from the output roll 118 instead just provides an upper facing for the upper wall of the corrugated cardboard structure.

To laminate or attach that upper facing to the uppermost web 130 of the corrugated cardboard structure, numerous approaches can be taken, but a typical one, as shown, involves spraying glue to an underside of the pre-printed web 126, as it unrolls off the output roll 118, using a glue sprayer 128, and then that pre-printed web 126 can be properly laminated or adhered onto the upper surface of the uppermost web 130 as the two webs 126, 130 are fed through a pair of pinch rollers 132.

That pre-laminated top wall 134 can then be fed down to a corrugator 136, which joins the three lower webs together in a known manner (the middle web 140 and the lowermost web 138 had meanwhile been fed also to the corrugator 136 as well).

The middle web has an additional process step applied to it before it is joined to the upper laminated web and the lower web: it is additionally passed through a corrugating device 142 which generally uses a fluted roller for folding flutes or corrugations therein.

The corrugator 136 then combines and glues these layers together, with the resulting corrugated sheet then being pinched together and heated to set the glue by further pinch rollers 144 and possibly blowers 162, thus forming the corrugated cardboard sheet.

That corrugated cardboard sheet is then further processed as appropriate for a particular customer's requirements, including cutting it to a predetermined length across the width of the web, e.g. using a reciprocal blade cutter 148, so as to form separate sheets or units 146 prior to then stacking those units 146 on a pallet 150. Only the cutting step is shown in this simplified schematic.

The physical arrangement of the various elements of these corrugated cardboard manufacturing machines can vary considerably over that which is shown schematically in FIG. 2. For example, it is generally the case that the machines 120 involve numerous linearly separated machines, rather than machines in which the rolls are arranged one above the other. Further, the various units, by being linearly arranged, can form a manufacturing line which is generally straight, albeit with vertical variations to accommodate the different layers of the corrugate and web tension maintenance mechanisms. Additional rollers, heaters and processing units (perforators, scorers, cutters, etc.) can also be provided as commonly known in the art.

A typical manufacturing line of this type can be in excess of 50 m in length.

In addition to the cross-cut (i.e. a transverse cut of the longitudinal web or sheet) as provided by the blade cutter 148 schematically shown in FIG. 2, longitudinal cuts are likely also to be made to the webs or corrugated sheet prior to stacking. A simplified form of longitudinal cutter is shown schematically in FIG. 8. Such longitudinal cutting equipment can utilised a blade such as a rotary blade cutter 152 for cutting the corrugated cardboard sheet 154 into two (or more, by the provision of further blades) separate lines 156*a*, 156*b*. The blades, e.g. where multiple such blades are provided, can also be for removing linear waste portions from the webs or sheet.

As shown, the rotary blade cutter 152 can be moved sideways across the width of the corrugated cardboard sheet 154 for accommodating different output requirements.

This therefore allows the equipment to adapt to accommodate different jobs along the length of the printed sheet media even where those jobs are arranged side by side.

With the digital printer(s), the relevant web can be printed directly within the machine 120 or off-line, dependent upon the location of the printer. However, pre-printing the webs 126 is generally more practical.

Figure 4:
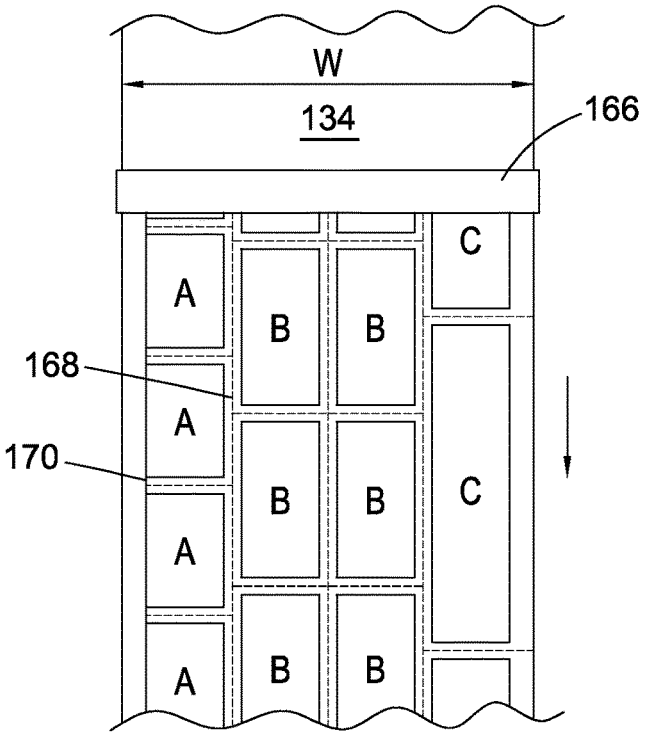
FIG. 4 shows a possible output from a digital printer in which images for three different product runs are being provided.

Referring now specifically to FIG. 4, there can be seen four side-by-side lines of printed images. The images take the form of three separate print runs A, B, C, with the leftmost print run being print run A, the middle two print runs being both print run B, and the rightmost print run being print run C.

Between the print runs dotted lines 168 are shown. Those dotted lines represent the location of cuts to be performed further downstream on the apparatus. They are not usually printed onto the web. They are shown in the drawings for illustrative purposes only.

Down one side of the web, there is also shown a solid, continuous line 170. This line often is printed by the printer. It provides a reference line for indexing further down the apparatus. The longitudinal cutting units 152 can be indexed off that solid, continuous line. Additional solid continuous lines might also be provided elsewhere on the web, especially where the web is split (as in FIG. 8) as the second line can provide the same purpose for the second of the lines.

The solid continuous line 170 may also feature marks for indicating where the transverse cuts are to be performed. Those marks could then be used as index marks for the crosscut blades 148, be that for a single crosscut unit, or multiple separate crosscut units (in which case the second continuous lines mentioned in the preceding paragraph would be beneficially present).

The four print runs A, B, C in FIG. 4 are printed using a single print bar 166, which extends across the full width W of a substantially continuous web 134. By being a single print bar 166, typically no movements of the print bar relative to the web 134 will be required. Given the lack of availability of very wide format digital printers for high-speed, roll-fed, sheets, it is likely that such a single print bar arrangement will be limited to applications where the web has a maximum width of perhaps 1 m. However, as wider print bars are produced by manufacturers, the width of the web can be widened too. As can be seen the print jobs do not have coincident ends—products A are shorter than products B and products C are longest of all. This form of printing cannot be achieved with a screen printer as a screen printer is limited to a fixed circumference and thus a fixed print periodicity. For this reason digital printers are preferred to be adopted for offering greater print flexibility and thus better order management, as will be explained further below.

To accommodate wider webs, multiple print bars can be provided, and the print bar(s) can be mounted on a carriage for being movable relative to the web (or the web may be movable on its rollers for movement relative to the print bar). The relative movement allows jobs with different waste margins to be accommodated, and potentially the printing of products with a wider width than the length of the print bar (where the printed part does not exceed the printer's length). This is further explained in relation to FIG. 7, in which two print bars are provided, each mounted on a movable carriage.

Referring next to FIG. 5, again a substantially continuous web 134 is shown. Further, a single print bar 166 is shown which extends across the full width of the web 134. This printer outputs the images for the separate jobs A, B, C, D organised onto the web in batches which group across the width of the web, rather than just along its length. This allows singular transverse cuts 172 to be used prior to longitudinal cuts for separating the substantially continuous web into stackable, or downstream processable, units (assuming that C and D have the same length). Again, however, the lengths of products A, B, C and D are not all common so screen printing is again unlikely to be useable.

Although only a single line of images B are shown, it is more probable that many hundreds of such images B would be presented sequentially. However, this image is just a schematic and is not intended to be representative of actual product order quantities (although such small batches are conceivably possible).

Figure 5:
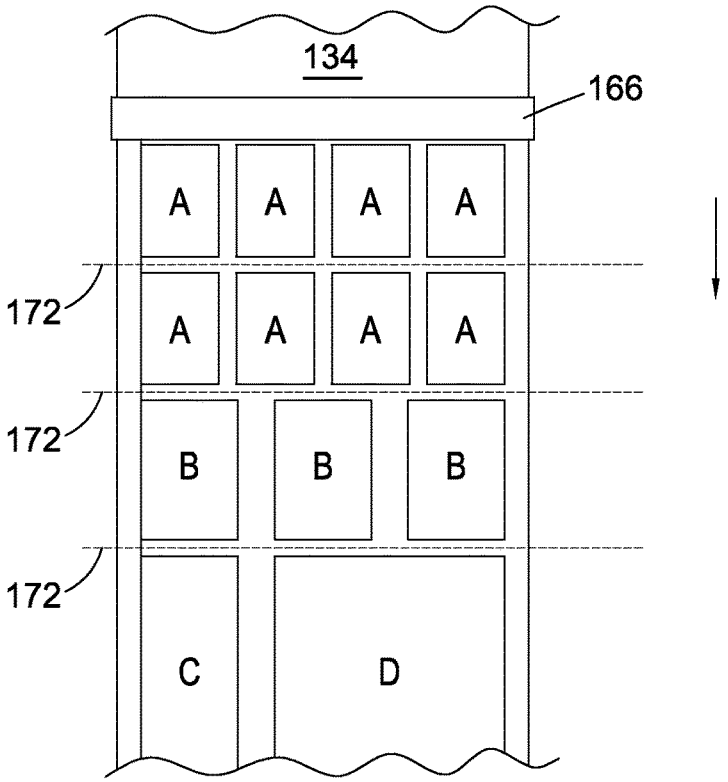
FIG. 5 shows a further possible output from a digital printer in which images for four different product runs are being provided.

In FIG. 5, images C and D are shown arranged side-by-side. This is again just illustrative of the flexibility provided by the digital print bar.

Figure 6:
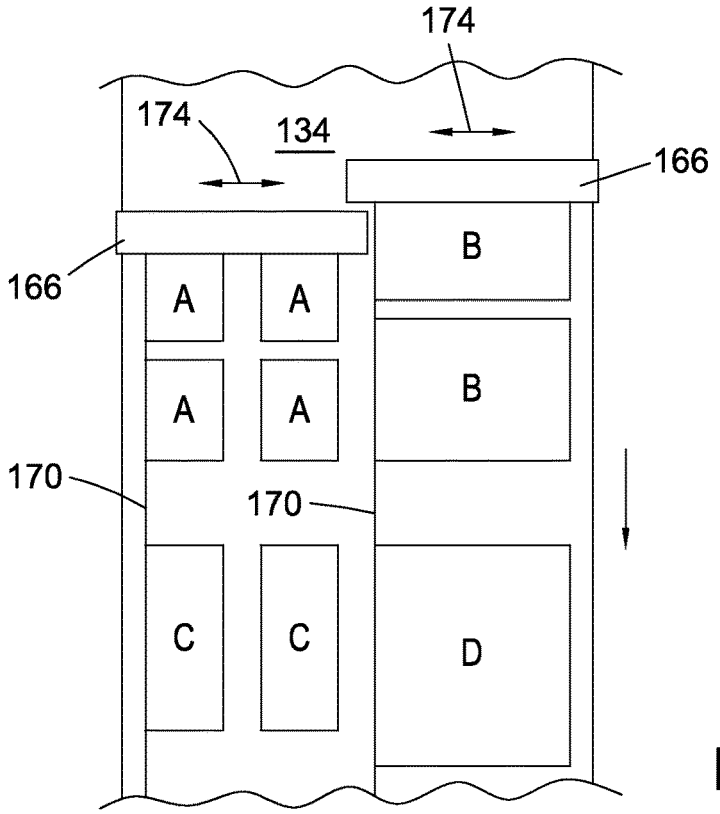
FIG. 6 shows an arrangement in which two digital printers are provided, and in which a slightly larger spacing between print jobs is being provided—slightly larger than the spacing between images of the same print job.

Referring next FIG. 6, a further substantially continuous web 134 is shown being printed by a digital printer arrangement. Here, however, there are two digital printers arranged substantially side-by-side across the full width of the web 134. Each digital printer illustrated is fractionally wider than half the width of the web, so they are parallel but overlapping. An example for a 2 m web, could be two Hewlett Packard T 400 colour inkjet web press printers, each being 42 inches wide and capable of printing paper feeding through it at 180 mpm.

In this arrangement, each printer 166 is mounted upon a carriage (not shown) to allow it to traverse 174 at least partially across the width of the web 134. This ability to traverse offers no function in the print jobs illustrated in FIG. 6, since each combination of print jobs being printed by each respective printer 166 is adequately accommodated by the printer 166 in its fixed default position, as illustrated. Therefore, the left-hand printer 166 has printed print job C in two lines of side-by-side images and is currently printing print job A also in two lines of side-by-side images. The right-hand side printer, however, is printing a larger image run B, and has already completed an area print run D.

Again the solid continuous line 170 is shown for allowing indexing of a cutting arrangement further down the system.

This figure additionally shows a second solid continuous line 170—printed by the second printer 166. The second indexing line is recommended to be provided where two printers are running together since each printer may not be perfectly indexed relative to the other printer, whereby an indexing line provided by one printer might not be perfectly aligned for the print run generated on the second printer.

Figure 7:
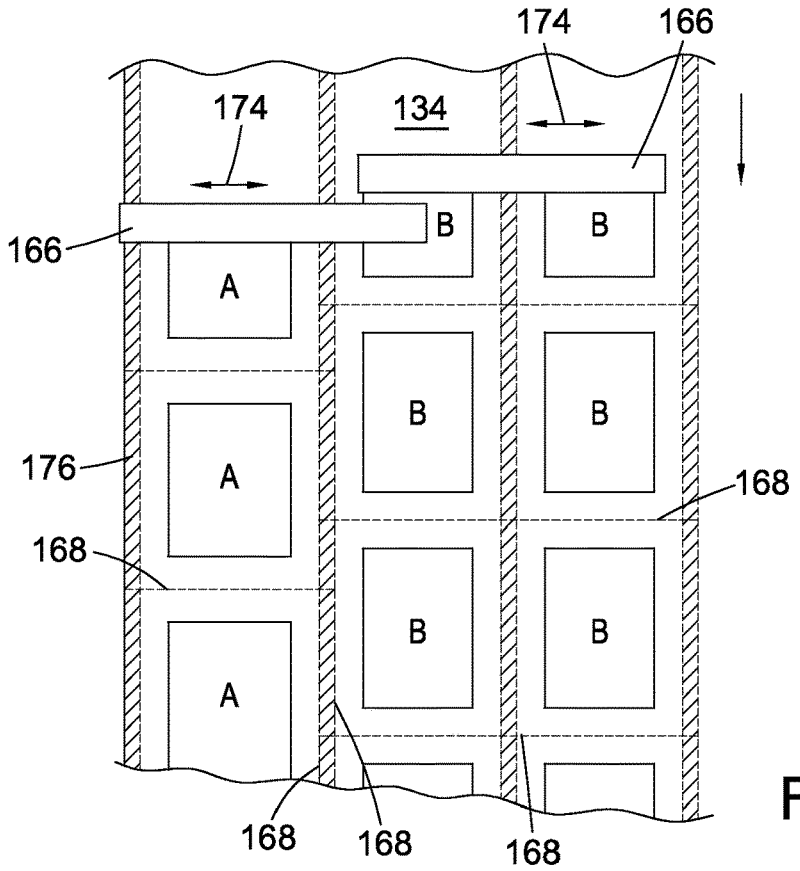
FIG. 7 shows another arrangement in which two digital printers are provided in which one of the printers is printing images for a pair of products the total combined width of which (including a trim area between them) exceeds the width of the printer.

Referring then to FIG. 7 a further arrangement is shown which further illustrates the flexibility of the digital printer arrangement of FIG. 6, and specifically the use of two digital printers, each mounted on a carriage for transverse movement relative to the web.

As shown in FIG. 7, two print runs A, B are being run at the same time, one by a left-hand print bar 166 and the second by the right-hand print bar 166. The first print bar 166 is printing a single print run having an image A, but with predefined waste edges 176 that will be cut away by longitudinal cutters 152 similar to the single blade cutter of FIG. 8 (typically there will be multiple independently moveable cuter blades). Around the image A, however, there are unprinted portions, which also form part of the product—the image covers only a part of the product. As such the print bar in theory can print an image for a product that is wider than the print bar—where the image is smaller than that product.

This concept is taken further by the second printer 166, which is actually printing two images, each defining a part of a further stackable unit 146. These two stackable units also have unprinted portions around their edges whereby the combined width of the two printed products (with the trim area therebetween) exceeds the width of the printer. This is achieved since the printer only needs to print the images, not the whole product, so as the images thereon together have a total width narrower than the printer, this product arrangement is within the printing capacity of the printer.

This capacity for wider product printing is further improved by the movability of the printers—this has allowed the right hand (second) printer to be away from the edge of the web. Had the printer 166 been positioned at the edge of the web 134, as per the left hand printer 166, the right hand printer 166 would not have been able to print both images. Therefore, by having the printers traversable relative to the web a wider variety of products can be printed by the non-full width printers.

It should also be appreciated that some of the relative movements between the printers and the web may be more beneficially achieved by moving the web relative to the rollers over which the web passes (either instead of or in addition to moving the printers relative to the rollers). This can have benefits since such web movements can be achieved very rapidly, whereas movement of the printers may need to be done more slowly since the printers may be inadequately robust to permit rapid sideways movements. Nevertheless, it can frequently be the case that one printer needs to be moved relative to the other printer, whereby movement of the printers themselves becomes useful and preferred.

Once printed, the web can be rolled for later processing (or if it is in-line it can be passed downstream to the downstream processing units).

Referring next to FIG. 9, a new feature of the present invention is shown—a reel map. Before now, such reel maps have not been needed or contemplated.

Standard operations practice has been for the corrugator/sheet processing apparatus 120 to be operated to produce a number (quantity) of products (boards/blanks) for meeting an order. There can then be a pre-programmed order change function (pre-programmed to occur at the completion of the order, i.e. after the target quantity was completed). These order change functions can be as simple as a prearranged cutter position change where there is no printed image, or where the image is unchanging between subsequent orders, or a switch out/splicing in of different layers when the sheet materials (or images) are to change, or a change in the corrugation settings when it is to be a change in corrugate form. Further, where automatable, these functions can often occur without operator input (the change-over rolls may be preloaded on standby, as are any alternate cutting arrangements).

This is all relatively straightforward when the printed paper is undamaged and when the corrugator all works correctly, whereby the initially produced quantity of products is correct for the first order, and of an approvable quality. However, when there is an error or problem, an operator would need to intervene, slowing down the feed speed where needed and overriding the order change function to prevent it from happening in the pre-programmed manner.

The form of the error or problem can have different consequences, but commonly if the boards have merely been damaged during production (something that is often noted when initial set-up tests are undertaken by looking at the product output), the operator can simply allow the apparatus to produce more of the products of the initial order—i.e. more than the initial intended quantity—for replacing the damaged products. However, this is only achievable while enough relevant paper remains on the wet end (i.e. upstream).

To allow for this additional images may have been pre-printed on the printed roll (and since there is less opportunity to alter the image when using a screen print, it is commonly the case that there would be many additional printed images as the whole roll may have been pre-printed—ready for repeat orders later on). However, it is also necessary for all the webs to be adequately and appropriately provisioned for the further products, and that might not be the case when they were intended to be switched out and replaced by a spliced in alternate for the next order. This process is thus undesirably inefficient on occasions.

Further, when using digital printing, the roll does not have numerous spare images. Instead it has an order set, and then subsequent order sets. As such the image changes along the roll, so running off further products is unlikely to be possible. As a consequence the order change function MUST occur when the initial pre-programmed quantity is completed (or when that part of the roll is reached). After all, thereafter the image will change on the outer liner.

Yet further, the inner liner and fluting papers typically need to order change before the outer liner (printed reel). This is to allow for the paper contained on the bridge and also the distance between the Single Facer and Double Backer.

A Reel Map is therefore a new concept that allows the corrugator to react to order changes before they are reached on the outer liner. It is a map or reference stored electronically in a control system of the corrugator/sheet processing apparatus and is effectively a look-up reference linking to a database of the various order parameters in a central repository. It provides a readable reference of the known or expected layout of the images on the digitally printed roll.

It works alongside Intelligent Marks or information markers that are printed actually onto the roll—in this example one for each image or artwork, and thus one for each product. The map additionally indicates approximately where on the roll the markers are positioned—herein in a rearward corner of each image, but in an area that will be trimmed away from the final product. See FIG. 10 for a more detailed illustration of possible locations on the roll.

The reel map thus provides a database of the markers, and what their images or artworks should look like, and their relative position in the order—i.e. first, second, third, lase, 10 from the end, etc. Likewise it will enable an anticipation of order changes—changes in the cutter settings and the like—to be provided as the real-time movement of the reel can be monitored and validated against the reel map to confirm there is no problem, with the reel map being a means for the control system to know where in the order the machine has got to, and to verify it against the readings from the markers. For that purpose a marker scanner is provided on the sheet processing apparatus/corrugator.

To allow the marker to relate to positions within the reel map, and thus perform a validation of the position of the reel/order/product, the marker will generally have two pieces of information: an order number or order code, also known as a CBS Step number, and a sequential indicator illustrative of the position within the order, such as a number between 1 and 999,999. As the number of printed images can be recorded in the reel map or database, that latter part, even as a number, can give the indication of where in the order the present marker sits, with the former part of the marker then additionally identifying the order. When read, the reel map can confirm that the read information is the expected information, thus confirming the position of the reel.

The information marker can be as simple as a number such as nnnnnnn-nnnnnn, where n represents a number. Preferably, however, the number is encoded into a rapidly readable format, such as a barcode or QR code—electronic scanners can read such encoded markers more efficiently than a straight string of numbers. A sample QR code is shown in enlarged form in FIG. 9.

It is desirable for the marker to fit inside a glue lap trim area of the artwork or inside the die cut tray trim area, or in some other waste part of the area surrounding a product. See, for example, FIG. 10 where the markers 50 are so positioned. It is also desirable that there be a marker for every image or artwork, as shown in FIG. 9 and in FIG. 10. This enables a very efficient and accurate tracking and checking of the position of the reel, and since the images can be of a significant size, such as over 1 m long in the case of some cardboard boxes, that close monitoring of the position has advantages—less wasted material passes through the machine between inspections and thus detected errors can only relate to a smaller amount of waste. It is also desirable for every marker on a roll, and potentially across all rolls within a defined area, be uniquely identifiable.

Referring next to FIGS. 11 to 13, the usefulness of the adaptability of the reel map is illustrated.

The table represents a reel map, and it has various columns representing the parts of the information markers—a order identifier (column 2 and 5) and a position identifier (columns 1 and 6). It also indicates particular jobs but as can be seen an order can comprise two separate jobs where they can be printed side by side, herein A and B, C and D and E and A, so more than one job can then have a common order identifier (herein 1, 2, 3). Further, the position identifier can be a count from the start of the printing on the roll, rather than restarting for each order—this is optional as position within the roll can be ascertained from either that count or the reel map as the order of the print orders is known from the reel map anyway.

It is also noted that an actual order can also be split into parts—e.g. A with B and A also, later, with E. This flexibility can allow greater efficiencies in the positioning of the orders on the roll of paper. It also allows downstream errors (such as corrugator failures) to be corrected as replacement images can be fitted in where appropriate onto rolls for orders using similar paper setups.

The reel map in FIG. 11 therefore shows the order in which the images are printed onto the roll. The reel map and the roll of paper therefore should match, and identification markers allow that to be checked. However, while printing the roll of paper, a quality control inspection of the image was carried out and errors in the images in rows 17 to 21 were noted—this error is reflected by emboldened print in FIG. 11. Those images thus will not be suitable for producing products. The reel map marks this by highlighting those rows as shown in FIG. 12.

To prevent foreseeable downstream wastage (the paper that would be used to form the board onto which the images are laminated, and which would have to be discarded later on if used) it is desirable to remove the bad images from the roll of paper. Thus, the printed reel is spooled onto a new core until the relevant section is reached and a cut is made so that the waste section can be run off into a shredder until good print resumes. Another cut is then made to remove the end of the waste and the two ends of the good sections are spliced together. This alteration is then likewise recorded in the reel map as shown in FIG. 13 where the first and sixth columns no longer record rows 17 to 21 as images, but instead record a splice at row 21 and record no image at rows 17 to 20 (as they were cut out). The reel map thus now again records a correct representation of the images.

The spooling also is not an additional step anyway as the printed roll typically needs to be spooled back anyway to get its order correct for processing on the corrugator (unless it was first printed in reverse).

As the reel map is now correctly reflecting the images on the roll of paper, when that roll is to be processed, the reel map can be accessed by the control system of the corrugator/sheet processing apparatus. The corrugator progresses through the roll and the plan, and both will match.

The first significant order change for the corrugator then to react to change is the order change at position 8 (first column, FIG. 13). The corrugator is able to order change the single facer at position 6, prior to the order change of the outer liner at position 8. This then ensures that the papers match and splices are contained within the order change section of the board. The need to change is thus foreseen and the change can occur with minimal waste at the change-over.

Should the corrugator stop or misfeed, or a paper break be experienced, the corrugator must be able to start up and synchronise with the reel map again as soon as possible.

The intelligent marks will enable this as they will link to the reel map so that position within the reel can be established simply by reading the information marker on an image and finding that image on the reel map. As shown in FIG. 14, where this stop or break is in the middle of an order, the effectively chopped out portion simply loses some of the order. However, when the processing resumes, the layers running in the corrugator, and the cutting arrangement's setup, will still be appropriate for the order. The system thus can quickly resume and find its place for ensuring that order changes occur at the correct point of the rolls. However, as seen in FIG. 15, the stop can occur at a position on the roll that bridges across two different orders. As a consequence, the cutting arrangements are likely to be wrong, and the papers might be too. In this circumstance it is likely that an operator will need to intervene to force a manual code change function to update the cutting arrangement or paper settings.

The present invention as described and claimed therefore enables a more automated tracking of a print roll, and the ability better to correct for errors or problems, and with less operator interaction. It also offers greater flexibility in the print layout and thus a more efficient use of the paper. It also facilitates more specific inventory control as there are the reel maps keeping an accurate record of the images printed on the various reels in stock. It also facilitates a reduction in waste when errors are noted in the printing of the rolls.

Referring next to FIG. 16, a wet end of a corrugator is shown. As can be seen the corrugator has six supply rolls 1A, 1B, 2A, 2B, 3A and 3B, a facer unit 200, a camera 300 and a backer unit 400. In the facer unit 200, a first web or sheet 210 is taken from one of the supply rolls (2A or 2B) and is combined with a second web or sheet 220 taken from a second supply roll (3A or 3B). Before combining them, one of the webs or sheets (210, 220) is corrugated so that as shown in FIG. 18, the output faced sheet 230 is a corrugated layer with a flat facing sheet.

Then in the backer unit 400, or as shown, in a combiner unit 500, that output faced sheet 230 is combined with a third sheet or web 240, taken from a third roll (1A or 1B), to form the backed and faced corrugate from which products can be cut—see, e.g. FIG. 20, which shows post-corrugation processing equipment, or dry end processing equipment, such as cutting or stamping equipment. Note too, that further corrugated layers may be applied elsewhere in the apparatus—FIG. 19, for example, shows a corrugator for forming a corrugate having a top sheet, a middle sheet and a bottom sheet, plus two corrugated layers separating those sheets. It likewise can feed the dry end processing equipment of FIG. 20.

Referring back to FIG. 17, it can be seen that a camera is mounted for inspecting one of the sheets of the corrugated—a printed layer. In this example, the printed layer is a bottom layer of the formed corrugate. FIG. 2 instead showed the top layer to be printed. Important, however, is that one of the sheets, inspectable by a camera, is printed, as the printing enables the tracking of the position of the layer by the control system of the invention—the camera inspects printed information markers, as previously described, for enabling a data look-up table to provide trackability.

The digitally printed reels are shown loaded at positions 1A and 1B, although they could instead be loaded at positions 3A and 3B, e.g. for use for the inside of the box. Reels at 2A and 2B are the fluting, and as that is faced by the other sheets, it is unlikely to ever be printed, although it might be for further tracking purposes.

Because the information markers are printed onto the sheet that is being inspected, a reel map for that sheet can be referenced (i.e. the look-up table can be consulted), so as to know the position along the reel at which the camera is currently inspecting. As that position will be a particular position within a product run, it will be known, as described above, what cutting requirements will be later needed for that position, so as the sheet feeds forwards the cutters can be adjusted appropriately. That relates to a dry end benefit from the information markers. The present invention also provides for a wet end benefit, however, in that it will also be known how many more product images will be presented before the next product run starts. It can thus be determined if a splicing unit needs to be activated to change the source material for that next product run, and the timing of that change can also be coordinated so that the splicing operation only happens at the print-change position. For the purpose of that splicing operation, there are two rolls provided for each of the three layers of the corrugate, and thus the materials from the rolls can be swapped over when needed. The sheets for the corrugate are thus changeable. This in turn can then be used to ensure that the required change of papers on reel stands 2 and 3 are synchronised with the order change on the printed media on reel stand 1.

This wet end tracking has particular benefits for the wet end as slack can form on the bridges 600 (see FIG. 19) within the wet end, thus making the timing of the cutting at the dry end less discernible from the information markers if they are being read at the wet end—the cutting occurs further downstream, after the bridges, and within the dry end, so cameras are again provided for the dry end, e.g. after the bridges, or within the dry end—e.g. after the corrugate is formed.

Various preferred features of the present invention has been described above purely by way of example. Modifications in detail may be made to the invention within the scope of the claims appended hereto.

The invention claimed is:

1. A corrugated sheet processing apparatus comprising:

sheet processing equipment comprising a corrugator and at least feed and guide rollers for selecting, moving and supporting sheets or webs to the corrugator for forming a corrugated sheet from which corrugated products can be cut, at least one layer of the corrugated sheet, and thus of the products, being formed from a printed sheet or web; and a control system for controlling the sheet processing equipment;

the corrugated sheet processing apparatus further comprising a visual inspection unit arranged for reading printed markers provided on at least one printed sheet or web as the printed sheet or web, and thus the printed markers to be read, pass through the corrugated sheet processing apparatus, or the corrugator thereof;

wherein:

the printed markers are printed information markers having information thereon;

the corrugated sheet is for more than one product order, the products of one order compared to a previous order having differing required details, the required details comprising any one or more of a) differing forms or types for at least one of the sheets or webs, b) differing numbers of webs, and c) differing glue types, glue temperatures, glue thickness or glue locations; and the control system further has a data look-up table comprising, for the products to be cut from the corrugated sheet, at least (1) details information associated with the said differing details, and (2) associated with said details information, identifier information readable from the printed information markers by the visual inspection unit, whereby the apparatus can identify what products will need to be produced downstream of the visual inspection unit, and identify in advance required settings for the sheet processing equipment or corrugator for those products, in response to a read printed information marker so that the sheet processing equipment or corrugator can be appropriately controlled by the control system to use the said required settings therefor such that the formed corrugated sheet from the corrugator meets the said required details of the identified product, wherein when a requirement change is noted, the sheet processing apparatus, and the corrugator, slow down.

2. The apparatus of claim 1, wherein each printed information marker is a QR code or bar code and the visual inspection unit includes an appropriate reader therefor.

3. The apparatus of claim 1, wherein the look up table is a reel map.

4. The apparatus of claim 1, wherein each marker is uniquely identified by its printed information whereby its position within a particular order can be ascertained.

5. The apparatus of claim 1, wherein two different product orders are sequentially positioned longitudinally along the length of the corrugated sheet.

6. The apparatus of claim 1, wherein only some of the printed images have an associated unique printed information marker.

7. A method of using the apparatus of claim 1, wherein the sheet or web with the information marker printed thereon is fed past the visual inspection unit, the information on the information marker is read and the information thereon is used by the control system to prepare the apparatus for any required changes to meet the required details of the identified product.

8. A method of using the apparatus of claim 1, wherein the control system is adapted to automate a timing of a change to allow the corrugated sheet formed in the corrugator to change within the material stream so as to alter from one form to another that matches a requirement set out in data look-up table for the product to be cut therefrom.

9. A method of using the apparatus of claim 1, wherein, upon noting a forthcoming requirement change by reference to the look-up table, and when an appropriate different source roll is already loaded into a splicing unit of the sheet processing equipment, the control system and the sheet processing equipment operate to switch out a first source roll and splice in the different source roll, so as to achieve a change in the material input for the corrugator.

10. The method of claim 9, wherein the switch is adapted to be triggered within a linear distance of travel of the sheet materials of 10 m, such that the switch is done by the time that the read information marker that noted the requirement change has moved further through the apparatus by no more than 10 m.

11. A method of using the apparatus of claim 1, wherein the sheet processing equipment is adapted to affect a reduction or increase in the number of layers within the corrugate.

12. A corrugated sheet processing apparatus comprising:

a control system; and downstream processing equipment, the downstream processing equipment comprising at least feed and guide rollers for moving or supporting a corrugated sheet and at least one cutting apparatus for cutting products from the corrugated sheet;

wherein:

the control system is for controlling at least the cutting apparatus;

the corrugated sheet processing apparatus further comprises a visual inspection unit arranged for reading printed markers provided on the corrugated sheet as the corrugated sheet, and thus the printed markers to be read, pass through the corrugated sheet processing apparatus past the visual inspection unit;

the printed markers are printed information markers having information thereon;

the corrugated sheet is for more than one product order, the products of one order compared to a previous order having differing details, comprising any one or more of a) differing shapes, and b) differing forms or types for cutter settings for the at least one cutting apparatus to be used for the products of that order; and the control system further has a data look-up table comprising, for the products to be cut from the corrugated sheet, at least (1) details information associated with the said differing details, and (2) associated with said details information, identifier information readable from the printed information markers by the visual inspection unit, whereby the apparatus can identify what product will need to be produced downstream of the visual inspection unit, and identify in advance the required cutter settings for the at least one cutting apparatus, in response to a read printed information marker so that the at least one cutting apparatus can be appropriately controlled by the control system to meet the required cutter requirements for the identified product;

wherein when a requirement change is noted, the sheet processing apparatus, and the downstream processing equipment, slow down.

13. The apparatus of claim 12, wherein each printed information marker is a QR code or bar code and the visual inspection unit includes an appropriate reader therefor.

14. The apparatus of claim 12, wherein the look up table is a reel map.

15. The apparatus of claim 12, wherein each marker is uniquely identified by its printed information whereby its position within a particular order can be ascertained.

16. The apparatus of claim 12, wherein two different product orders are sequentially positioned longitudinally along the length of the corrugated sheet.

17. The apparatus of claim 12, wherein only some of the printed images have an associated unique printed information marker.

18. The apparatus of claim 12, wherein the cutting apparatus includes one or more longitudinal cutting unit or blade for cutting the corrugated sheet lengthways to define a predetermined width for a part thereof and the predetermined width is part of the information retained in the look-up table.

19. The apparatus of claim 12, wherein the apparatus comprises one or more cross-cut apparatus adapted to cut the corrugated sheet into a predetermined length to form lengths for stacking and the predetermined length is part of the information retained in the look-up table.

* * * * *